US005950399A

United States Patent [19]

Viens et al.

[11] Patent Number: 5,950,399

[45] Date of Patent: Sep. 14, 1999

[54] APPARATUS AND METHOD FOR INSERTING A PRODUCT INTO AN ENVELOPE AND CLOSING SAME

[75] Inventors: Wilfred S. Viens, Lisbon, Conn.; George L. Denison, III, Hope Valley; Donald Simmons, Ashaway, both of R.I.; Charles F. DeGaetano, Groton, Conn.

[73] Assignee: Gunther International, Ltd., Norwich, Conn.

[21] Appl. No.: 09/081,978

[22] Filed: May 20, 1998

Related U.S. Application Data

[60] Provisional application No. 60/062,006, Oct. 17, 1997.

[51] Int. Cl.[6] ..... B65B 43/26

[52] U.S. Cl. ..... 53/381.6; 53/284.3; 53/569; 53/281.7; 53/385.1; 53/386.1

[58] Field of Search ..... 53/460, 206, 284.3, 53/569, 381.7, 381.6, 381.5, 385.1, 386.1; 493/216, 921

[56] References Cited

U.S. PATENT DOCUMENTS

| | | | |
|---|---|---|---|
| 3,858,381 | 1/1975 | Huber et al. | 53/188 |
| 3,981,270 | 9/1976 | Bogdanski | 118/257 |
| 4,064,674 | 12/1977 | Palmer | 53/23 |
| 4,149,356 | 4/1979 | Palmer | 53/459 |
| 4,365,458 | 12/1982 | Palmer et al. | 53/449 |
| 4,428,794 | 1/1984 | Hayskar et al. | 156/442.1 |
| 4,462,199 | 7/1984 | Polit | 53/266 |
| 4,499,705 | 2/1985 | Russell | 53/266 |
| 4,551,188 | 11/1985 | Schulze | 156/44.1 |
| 5,042,232 | 8/1991 | Orsinger et al. | 53/460 |
| 5,097,654 | 3/1992 | Latsounas et al. | 53/569 |
| 5,125,215 | 6/1992 | Orsinger et al. | 53/492 |
| 5,242,499 | 9/1993 | Bergman | 118/669 |
| 5,326,587 | 7/1994 | Bergman | 427/8 |
| 5,388,388 | 2/1995 | Belec et al. | 53/460 |
| 5,408,811 | 4/1995 | Satake | 53/569 |
| 5,428,944 | 7/1995 | Belec et al. | 53/492 |
| 5,447,015 | 9/1995 | Belec et al. | 53/492 |
| 5,511,774 | 4/1996 | Lyga | 271/273 |
| 5,618,375 | 4/1997 | Suzuki et al. | 156/442.3 |
| 5,651,238 | 7/1997 | Belec et al. | 53/504 |

*Primary Examiner*—Joseph J. Hail, III
*Assistant Examiner*—William Hong
*Attorney, Agent, or Firm*—Ware, Fressola, Van der Sluys & Adolphson LLP

[57] ABSTRACT

An apparatus for inserting a folded product into an envelope and closing the flap of the envelope performs a method in which the envelope is transferred from an envelope hopper by a rotatable shuttle unit having cooperating suction cups and a T-shaped flap engagement member, the folded product is stuffed into its envelope, and then flap of the envelope is closed by an envelope closing device. The envelope inserting and closing apparatus and method are designed for use in a high speed electronic finishing system.

47 Claims, 5 Drawing Sheets

APPARATUS AND METHOD FOR INSERTING A PRODUCT INTO AN ENVELOPE AND CLOSING SAME

This application claims benefit of Provisional Application 60/062,006 Oct. 17, 1997.

BACKGROUND OF THE INVENTION

1. Field of the Invention

The present invention relates to an apparatus and method for inserting documents into envelopes and, more particularly, to an apparatus and method for inserting folded documents into envelopes in a high-speed electronic finishing system.

2. Description of the Prior Art

In the electronic finishing field, multi-page documents such as insurance policies and contracts are printed on high-speed laser printers and then finished on an electronic finishing system which assembles the document and adds any desired inserts (such as prefolded advertising brochures or other solicitations) to the document to create a product which are sometimes folded in manner set forth in U.S. Pat. No. 5,554,094. Then, the product is inserted into a standard envelope to create a package ready for mailing. These steps are done at high speed while the accuracy of the document assembly is verified through use of a printed bar code on each sheet of the document.

Envelope inserters found in the prior art are complicated requiring separate assemblies to feed, position, open and stuff the envelope. These separate assemblies require numerous moving parts and constant maintenance. The prior art envelope inserters also encounter difficulty in handling packages of varying thicknesses.

SUMMARY OF THE INVENTION

The present invention is designed to overcome the above limitations that are attendant upon the use of "prior art" devices, and toward this end, it contemplates the provision of a novel apparatus and method for inserting documents into envelopes and closing the flaps on the envelopes to create finished packages.

It is an object of the present invention to provide an apparatus and method utilizing one cycle to feed, position and open the envelopes thereby preparing them for insertion of folded documents to create finished packages.

It is also an object to provide such an apparatus and method which dynamically handle a range of thicknesses of packages.

Yet another object is to provide an apparatus and method which accomplish the desired insertion at high speeds.

A further object is to provide an apparatus that is compatible with conventional electronic finishing systems and is generally compatible in physical size, form and configuration with such systems, to be readily adaptable for the same use without disadvantage.

It is a general aim of the invention to provide such an apparatus which may be readily and economically fabricated and will have long life in operation and significantly greater flexibility in use.

It has now been found that the foregoing and related objects can be readily attained in an apparatus and method in accordance with the present invention which inserts a folded document in an envelope and closes the flap of the envelope to create a finished package.

According to the invention, an inserting device is provided which comprises (1) a product conveying device for delivering one sequentially delivered product at a time along a product conveying path, (2) a flap positioning unit for positioning a flap of an envelope on a shuttle unit adjacent the product conveying device for each sequentially delivered product, and (3) a shuttle unit for holding the flap of the envelope positioned by the flap positioning unit and transporting the envelope by the flap to a position in the product conveying path of its respective sequentially delivered product, whereby its respective sequentially delivered product is inserted within the envelope to create a package.

To insert a product in an envelope to create a package, a sequentially delivered product is provided on the product conveying device. An envelope with a flap is provided to the flap positioning unit for each sequentially delivered product. The flap of the envelope is positioned on the shuttle unit adjacent the product conveying device for each sequentially delivered product and the flap of the envelope positioned by the flap positioning unit is held on the shuttle unit. Finally, the shuttle unit transports the envelope by the flap to a position in the product conveying path of its sequentially delivered product and the sequentially delivered product is inserted within the envelope to create a sequentially delivered package.

To close the package, a package closing device is provided and comprises (1) a package conveying device for delivering one sequentially delivered package at a time along a package conveying path, (2) first and second rollers forming a first pair of rollers in the package conveying path for receiving each sequentially delivered package from the package conveying device, the first roller having an enlarged diameter at its midsection for at least partially sealing the flap of each sequentially delivered package and forcing trapped air from each sequentially delivered package, and (3) third and fourth rollers forming a second pair of rollers adjacent the first pair of rollers for receiving each sequentially delivered package from the first pair of rollers, the third and fourth rollers are matched so as to provide substantially even pressure across the flap of each sequentially delivered package to fully seal the flap of each sequentially delivered package.

In utilizing the package closing device, the sequentially delivered package is provided on the package conveying device and is conveyed to the first pair of rollers in the package conveying path to at least partially seal the flap of the sequentially delivered package and force trapped air from the sequentially delivered package. Thereafter, the sequentially delivered package is conveyed from the first pair of rollers to the second pair of rollers to fully seal the flap of the sequentially delivered package.

The invention will be fully understood when reference is made to the following detailed description taken in conjunction with the accompanying drawings.

DETAILED DESCRIPTION OF THE INVENTION

Figure 1:
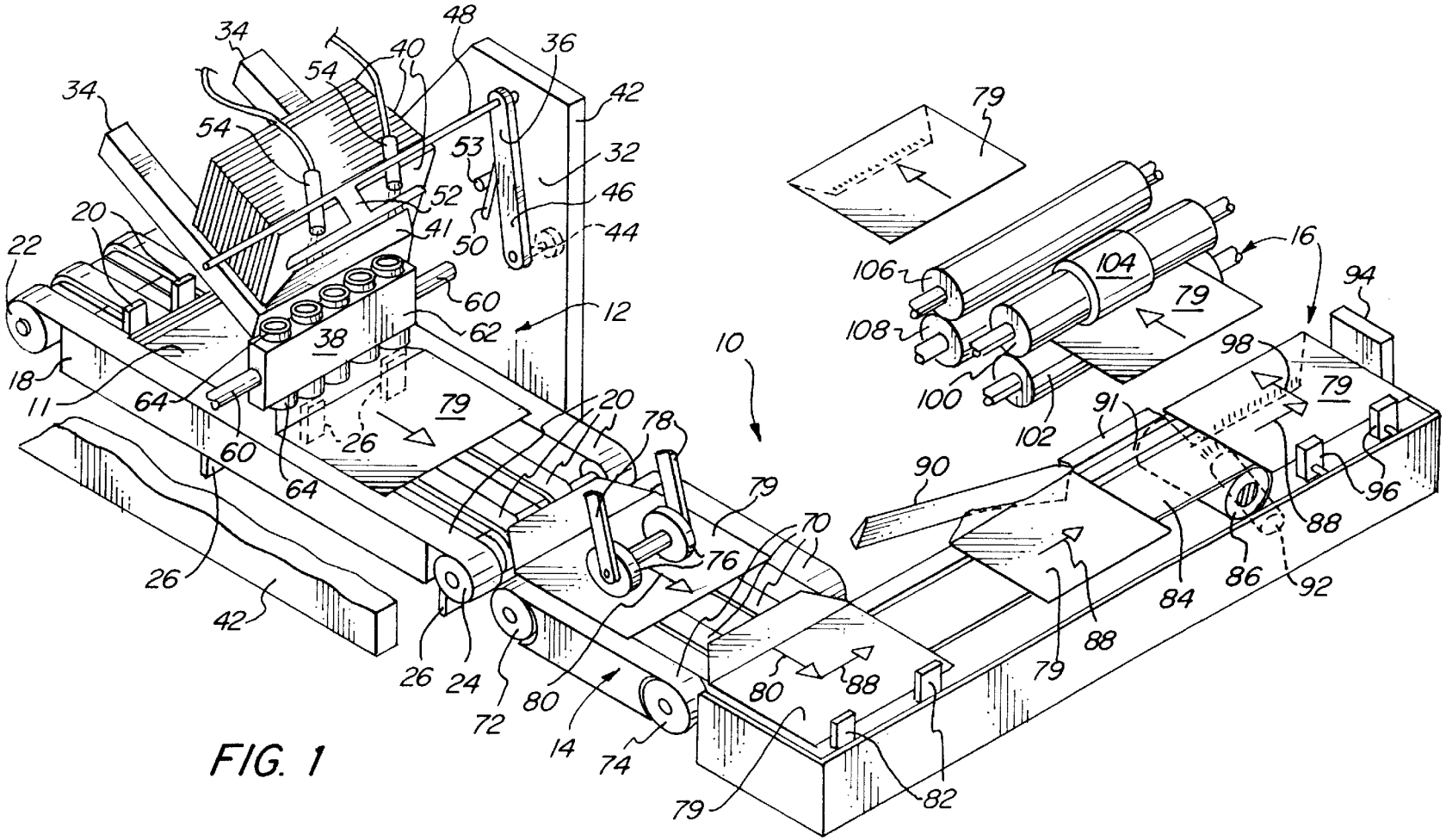
FIG. 1 is a schematic perspective view of an apparatus of the present invention for the insertion of documents into envelopes with a portion of one of the pair of panels broken away and the components thereon removed to show the structure therebehind.

Turning first to FIG. 1 of the drawings, therein illustrated is an envelope inserting apparatus which is generally designated by the numeral 10 and is made in accordance with the present invention. The envelope inserting apparatus 10 includes an envelope inserting device generally indicated by the numeral 12, a transfer conveyor device generally indicated by the numeral 14 and an envelope closing device generally indicated by the numeral 16. The envelope inserting apparatus 10 is part of an electronic finishing system such as that shown in U.S. Pat. No. 5,554,094 which produces folded products 11 delivered to the envelope inserting apparatus 10 in a high speed manner. U.S. Pat. No. 5,554,094 is incorporated herein by reference.

The envelope inserting device 12 has an endless chain conveyor unit 18 which has product guides 20 along an endless path formed around a series of spaced rollers 22, 24 which drive the endless chain system (not shown). A plurality of product pusher fingers 26 are mounted on the endless chain system to follow the endless path for transporting the folded product 11 along the endless chain conveyor unit 18 as will be described further hereinafter. A self-adhesive one-way angled pile fabric material (not shown) made by Norton Fluorplast B.V., Raamsdonksveer, The Netherlands is placed on the guides 20 to facilitate movement of the folded product 11.

Mounted above the endless chain conveyor unit 18 is an envelope transfer unit 32 having an envelope hopper 34, a flap positioning unit 36 and a rotary shuttle unit 38. The envelope hopper 34 is provided with a plurality of standard envelopes 40 with flaps 41. The envelopes 40 are mounted in the envelope hopper 34 in an inclined manner for presenting the envelopes 40 one-by-one to the flap positioning unit 36 for transfer to the shuttle unit 38.

The flap positioning unit 36 includes a pair of panels 42 (one shown in full and one broken away in FIG. 1) respectively flanking either side of the endless chain conveyor unit 18. The flap positioning unit 36 also includes a pair of opposed rotatable pins 44 (only one shown in FIG. 1), one journalled in each of the respective panels 42 to define a pivot axis for two crank arms 46 (only one shown in FIG. 1). Each crank arm 46 is attached to a respective one of the rotatable pins 44 for rotation therewith. At least one of the rotatable pins 44 is driven by an appropriate drive mechanism (not shown) in a manner described further hereinafter. Extending between and through the ends of the crank arms 46 spaced from the rotatable pins 44 is a rotatable bar 48 rotatably journalled in the two crank arms 46. The rotatable bar 48 has actuation fingers 50 (only one shown in FIG. 1) cantilevered at a ninety degree (90°) angle thereto on either end thereof. The actuation fingers 50 are located between the crank arms 46 and the panels 42. In the span of the rotatable bar 48 between the crank arms 46, a T-shaped flap engagement tamper member 52 is attached to the rotatable bar 48 by its base for rotation therewith. The T-shaped flap engagement tamper member 52 is preferably made of a flexible plastic material such as reinforced LEXAN.

It should be noted that each of the panels 42 has a cantilevered stud 53 (only one shown in FIG. 1) extending therefrom, each in operational engagement with a respective one of the actuation fingers 50. It should also be noted that the rotatable bar 48 is provided with at least one spring 53 (FIGS. 2 and 3) positioned therearound to bias the actuation fingers 50 into engagement with the cantilevered studs 51. Positioned between the envelope hopper 34 and the T-shaped flap engagement tamper member 52 is a pair of air blast units 54 for providing an air blast to the flap 41 of the next envelope 40 to be fed from the envelope hopper 34.

The shuttle unit 38 is rotatably mounted between the pair of panels 42 and under the T-shaped flap engagement tamper member 52. The shuttle unit 38 has a hollow rotatable shaft 60 journalled in the pair of panels 42 and a vacuum housing 62 having two rows of suction cups 64 thereon. The rows of suction cups 64 are positioned on opposite sides of the vacuum housing 62 parallel to the hollow rotatable shaft 60. The hollow rotatable shaft 60 is operationally connected to a vacuum source (not shown) so as to create a suction force at the suction cups 64 through the vacuum housing 62. It is also operationally connected to an appropriate drive mechanism (not shown) to rotate it in a manner to be described further hereinafter.

Cooperating with the endless chain conveyor unit 18 along an abutting portion thereof is the transfer conveyor device 14 having a plurality of endless belts 70 which follow an endless path around rollers 72, 74. A series of upper rollers 76 (one pair shown in FIG. 1) is located above the endless belts 70. The rollers 76 are rotatably mounted on the end of pivot arms 78. This arrangement permits finished packages 79, each comprised of an envelope 40 with a folded product 11 therein, to move in the direction indicated by arrow 80 (FIG. 1) for a purpose to be explained further hereinafter.

The envelope closing device 16 is located at the end of the transfer conveyor device 14 for receiving the finished packages 79 from the transfer conveyor device 14 against stop members 82. The stop members 82 have a self-adhesive one-way angled pile fabric material (not shown) made by Norton Fluorplast B.V., Raamsdonksveer, The Netherlands placed thereon to prevent rebounding of the finished packages 79. The envelope closing device 16 has an endless belt 84 which follow an endless path around rollers 86 (one shown). A series of upper rollers (not shown), similar to the series of rollers 76, is located above the endless belt 84 for maintaining the finished packages 79 in contact with the endless belt 84. This arrangement permits the finished packages 79 to move in the direction indicated by arrow 88 (FIG. 1) past a plow-like member 90 for engaging the flaps 41 of the finished packages 79 to position them between a pair of guides 91. Downstream of the plow-like member 90 is a water blast unit 92 for moistening the adhesive on the flaps 41 with an atomized air/water mist.

Figure 11:
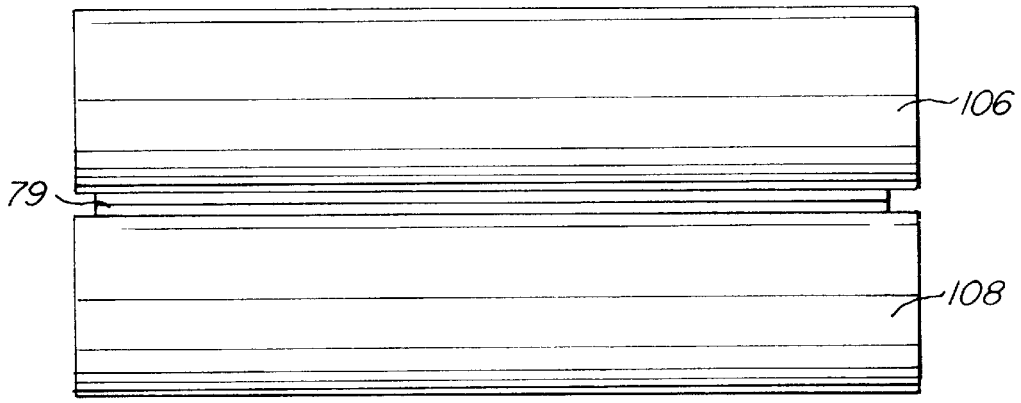
FIG. 11 is an end view of the second pair of rollers used in the envelope closing device.

At the end of the envelope closing device 16 is an abutment member 94 against which each finish package 79 indexes. The abutment member 94 has a self-adhesive one-way angled pile fabric material (not shown) made by Norton Fluorplast B.V., Raamsdonksveer, The Netherlands placed thereon to prevent rebounding of the finished packages 79. A dual finger pusher 96 is laterally positioned on the envelope closing device 16 and is reciprocally driven to engage the finished package 79 and push it in a direction of arrow 98 into the nip of a first pair of rollers 100, 102 of the envelope closing device 16. The upper roller 100 of the first pair has an enlarged diameter at its midsection 104. A second pair of rollers 106, 108 is located downstream of the first pair of rollers 100, 102 and both have the same diameter along their entire length (see FIG. 11).

As explained in U.S. Pat. No. 5,554,094, sheets of paper to be fed into the electronic finishing system are placed into a primary document feeder. The document feeder separates the sheets into individual stacks. For example, the stacks could be individual insurance policies. Each sheet in each assembled stack of sheets has had a bar code printed thereon to verify the accuracy of its assembled stack. Bar code readers and sensors are appropriately located throughout the electronic finishing system so the computer processing unit can monitor each stack of sheets as it proceeds through the electronic finishing system. As the stacks exit from the document feeder, they are transferred onto a high-speed conveyor system which transports the stacks for stapling by a stapler. The user can choose whether a stack is to be stapled or not through use of the computer processing unit or the computer processing unit automatically chooses stapling or not based on various factors, e.g., the number of sheets in the document. The stacks are then transferred by the high-speed conveyor system to a plurality of insert feeders spaced above the high-speed conveyor system for feeding inserts onto the stacks to create products. The computer processing unit controls the operation of the insert feeders and signals them to feed the appropriate insert(s) in accordance with the specific needs of stacks passing underneath. Thereafter, the products continue to a folding unit where they are folded, e.g. in half, to form a folded product 11 as shown in FIG. 1 of the present application. This folded product 11 is ready for insertion into an envelope 40 by means of the present invention to create finished packages 79.

Figure 2:
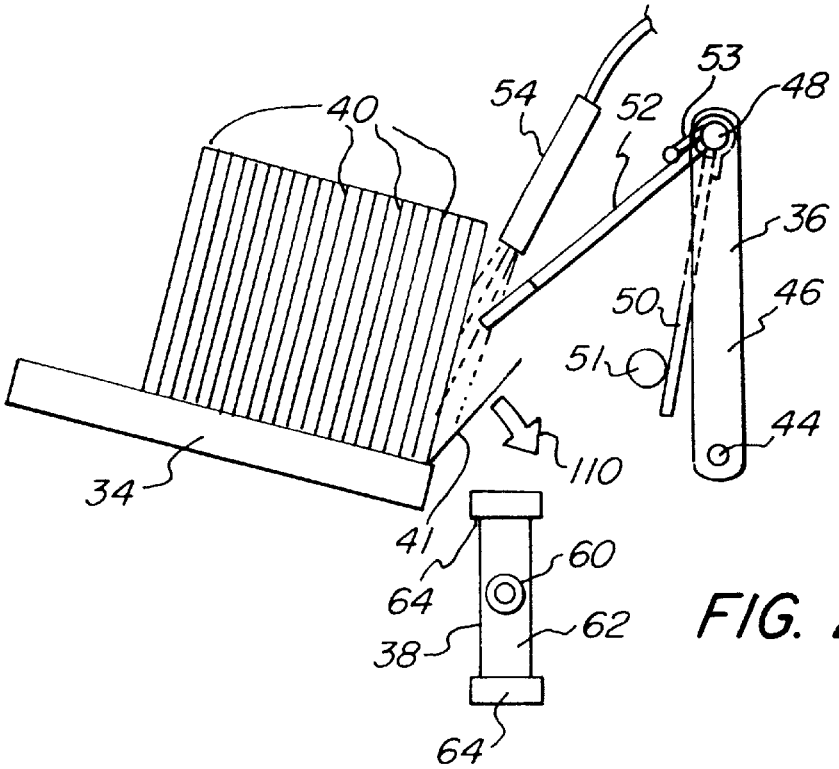
FIGS. 2 through 6 are schematic side elevational views and a schematic top plan view (FIG. 4A) of portions of the insertion apparatus of the present invention performing the insertion method of the present invention.
Figure 3:
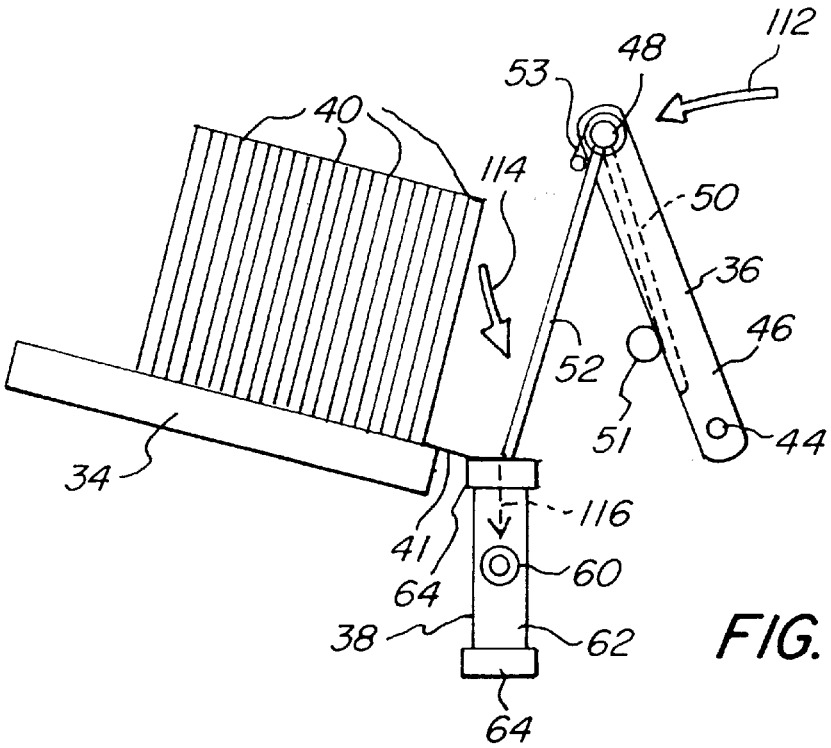
Figure 4:
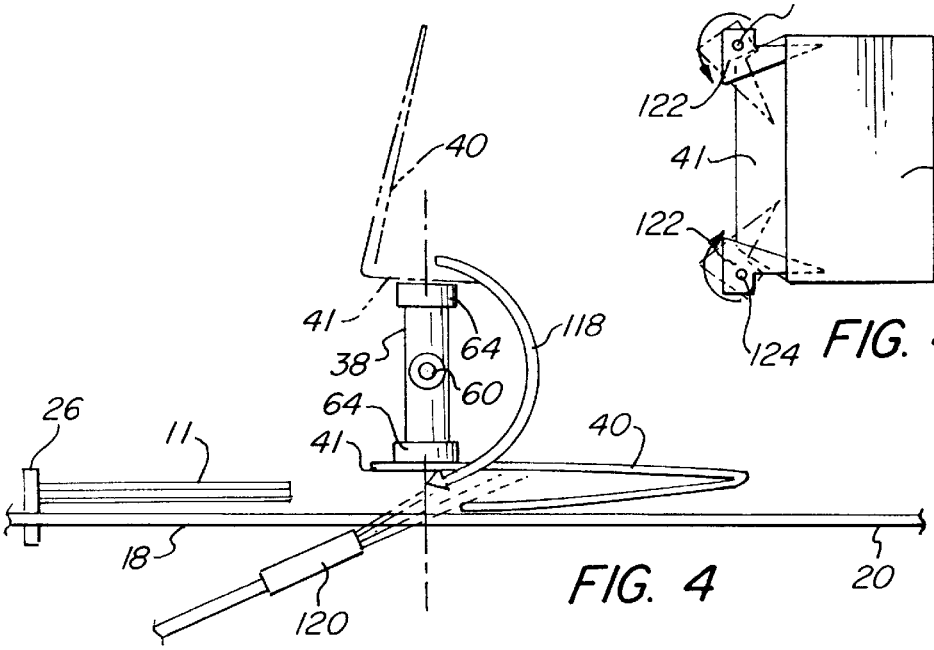
Figure 4A:
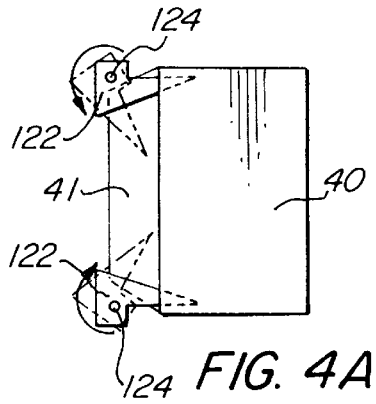

The operation of the envelope inserting device 12 of the envelope inserting apparatus 10 can be clearly understood when considering FIGS. 2–5. It should first be understood that appropriate well-known reflective fiber optic sensors (not shown) are located in appropriate positions along the travel paths in the envelope inserting apparatus 10 to detect the presence (or absence) of the products 11, envelopes 40 and finished packages 79 thereon. In FIG. 2, the air blast units 54 of the envelope transfer unit 32 has just applied a blast of air to the flap 41 of the next envelope 40 to be fed from the envelope hopper 34 to force the flap 41 in the direction of arrow 110. As this is done, the rotatable pins 44 rotate under the influence of their drive mechanism thereby rotating the crank arms 46 around their pivot axis as illustrated in FIG. 3 in the direction of arrow 112. The operational engagement of the actuation fingers 50 with the cantilevered studs 51 moves the T-shaped flap engagement tamper member 52 in the direction of arrow 114 to force the flap 41 into engagement with the suction cups 64 where it is held under the influence of the vacuum force illustrated by arrow 116. A computer processing unit (not shown), which controls the operation of the envelope inserting apparatus 10 and has been monitoring the next folded product 11 to be inserted as it has proceeded through the electronic finishing system, activates the drive mechanism of the shuttle unit 38 so the hollow rotatable shaft 60 rotates one hundred eighty degrees (180°) as illustrated by arrow 118 in FIG. 4 to bring the envelope 40 from the phantom line position to the full line position adjacent the first endless chain conveyor unit 18. A second air blast unit 120 located below the shuttle unit 38 injects air into the envelope 40 to prepare it for insertion of the folded product 11. Prior to the insertion of the folded product 11, a pair of opening fingers 122 (FIG. 4A) located below the shuttle unit 38 is pivoted at pins 124 from their phantom line positions outside the envelope 40 to their solid line positions inside the envelope 40 to hold the envelope 40 securely open for insertion of the folded product 11.

Figure 5:
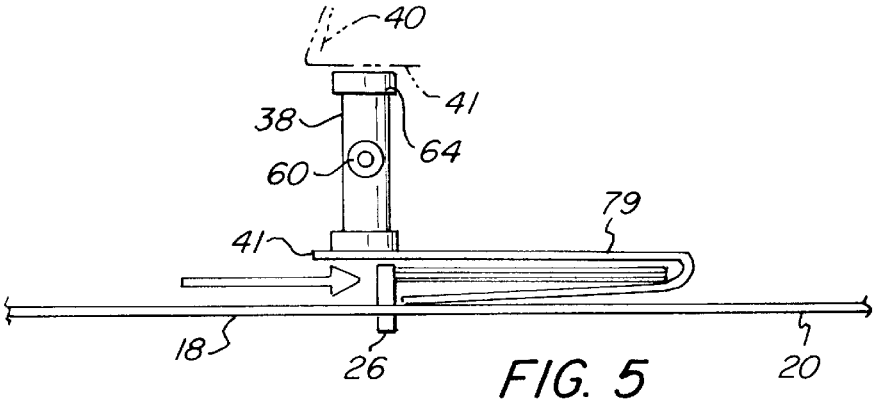

Turning now to FIG. 5, the folded product 11 is slid into the opened envelope 40 by the product pusher fingers 26 to form the finished package 79. As shown in FIG. 5, as the first envelope 40 is fed, opened and stuffed with its folded product 11, a second envelope 40 shown in phantom line is being staged (in a manner shown in FIGS. 2 and 3) on the top of the shuttle unit 38.

After the folded product 11 is inserted into the envelope 40 to create the finished package 79, the flap 41 of the envelope 40 forming the finished product 79 is released from the suction cups 64 and continues to travel down the endless chain conveyor unit 18 under the influence of the product pusher fingers 26 until it reaches the transfer conveyor device 14.

Figure 6:
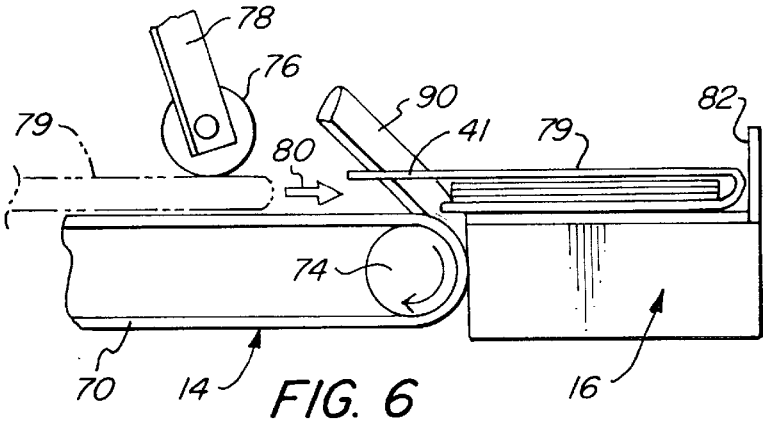

When considering FIGS. 6–11, the remaining operation of the envelope inserting apparatus 10 can also be clearly understood. As shown in FIG. 6, the finished package 79 is fed from the transfer conveyor device 14 onto the envelope closing device 16 until it reaches the stop members 82.

Figure 7A:
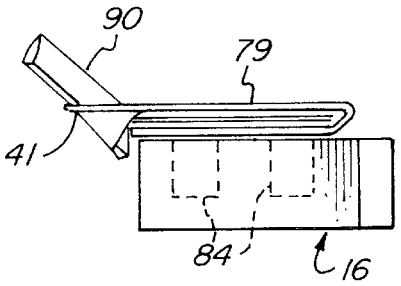
FIGS. 7A and 7B are schematic side elevational and top plan views, respectively, illustrating the initial manipulation of the flap of an envelope during the closing of the envelope.
Figure 7B:
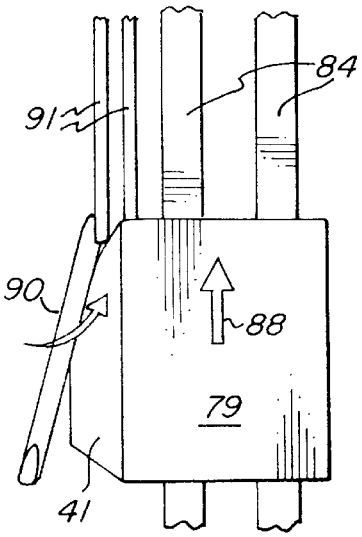

Referring now to FIGS. 7A and 7B, the direction of movement of the finished package 79 changes by ninety degrees (90°) and the flap 41 is bent downwards as it engages the plow-like member 90 and is positioned between the guides 91.

Figure 8A:
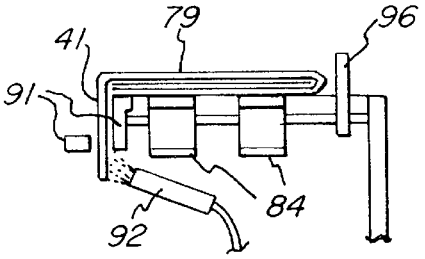
FIG. 8A is a schematic side elevational view illustrating the moistening of the flap of an envelope during the closing of the envelope.
Figure 8B:
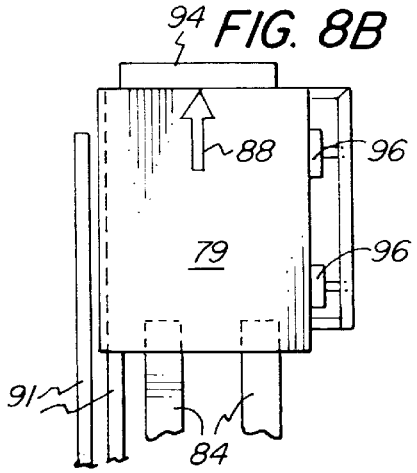
FIG. 8B is a schematic top plan view illustrating an envelope engaging an abutment member on the envelope closing device.

In FIGS. 8A and 8B, the finished package 79 continues along the first endless chain conveyor unit 18 where the water blast unit 92 moistens the adhesive on the flap 41 just before the finished package 79 engages the abutment member 94.

Figure 9A:
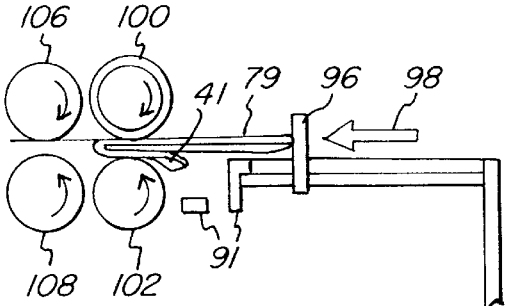
FIGS. 9A and 9B are schematic side elevational and top plan views, respectively, illustrating the closing of the flap of an envelope as it passes through a first and second pairs of rollers.
Figure 9B:
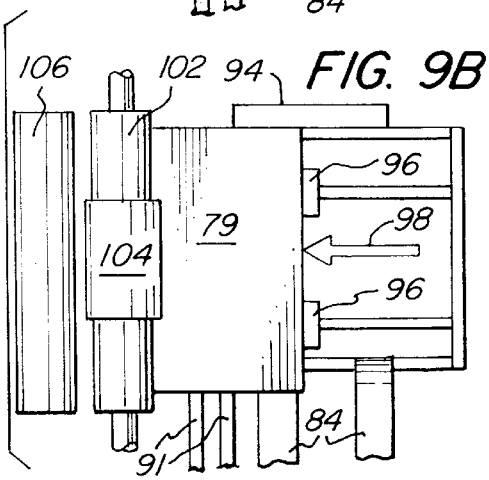
Figure 10:
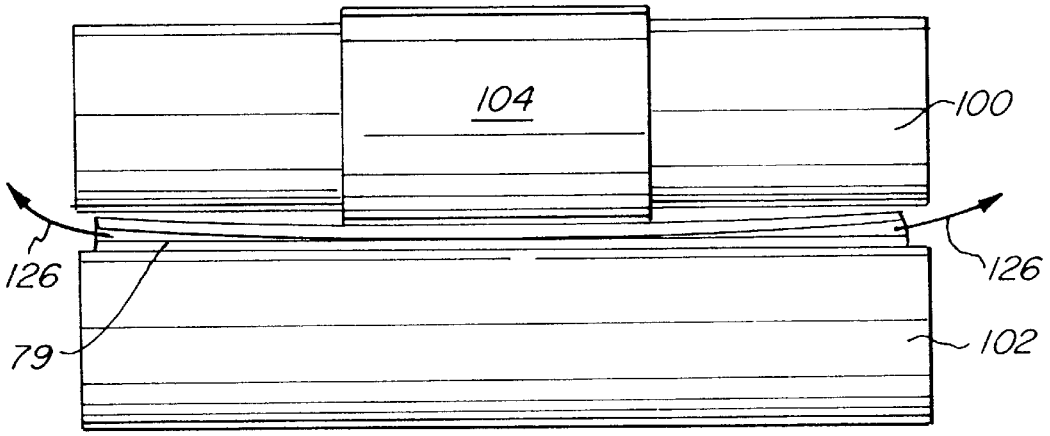
FIG. 10 is an end view of the first pair of rollers used in the envelope closing device.

As seen in FIGS. 9A and 9B, after the finished package 79 reaches the abutment member 94, the direction of movement of the finished package 79 is changed by ninety degrees (90°) by pusher 96 and the flap 41 begins to close as the finished package 79 engages the lower guide 91 and moves between the rollers 100, 102 and 106, 108. As can be best seen in FIG. 10, due to the roller 100 having the enlarged diameter at its midsection 104, the first pair of rollers 100, 102 closes the middle of the flap 41 and forces the air illustrated by arrows 126 out of the finished package 79. While in FIG. 11, the second pair of rollers 106, 108 completes the closure by providing even pressure across the entire finished package 79. The artisan skilled in the art will appreciate that the rollers 100, 102, 106, 108 are provided with appropriate spring pressure to prevent bouncing of the rollers when the finished package 79 are introduced thereto and provide the appropriate pressure for closure of the flap 41.

In a manner known from U.S. Pat. No. 5,554,094, the finished package 79 is introduced with its front side down to an indexing conveyor (not shown) which transports the finished package 79 to the means (not shown) for applying the proper postage to the finished package 79. The finished packages 79 with postage applied proceed onto a slowly indexed conveyor (not shown) where all the finished packages 79 are aligned in a shingled manner ready to be mailed.

Although not explained in detail, it will be appreciated by those skilled in the art that the envelope inserting apparatus 10 is event driven and appropriate sensors (e.g. well-known reflective fiber optic sensors) are located throughout the envelope inserting apparatus 10 to ensure that the various components thereof are in the proper position during each sequence of operation. The computer processing unit (not shown) controls the operation of the entire electronic finishing system including the envelope inserting apparatus 10. This arrangement provides a fail safe system whereby damage to the machine is prevented and quality of the finished packages is assured.

Thus, artisans skilled in the art will appreciate that the envelope inserting apparatus 10 of the present invention as described herein can be employed advantageously to receive folded products 11, insert them into envelopes 40, and then close the envelopes 11 in an efficient and convenient manner. It will, therefore, be seen from the above that the invention described admirably achieves the objects of the invention. However, it will be appreciated that departures can be made by those skilled in the art without departing from the spirit and scope of the invention, which is limited only by the following claims.

Having thus described the invention, what is claimed is:

1. An apparatus for inserting a product in an envelope thereby forming a package, which comprises:

(a) a product conveying device for delivering one sequentially delivered product at a time along a product conveying path;

(b) a flap positioning unit for positioning a flap of an envelope on a shuttle unit adjacent said product conveying device for each sequentially delivered product; and (c) a shuttle unit for holding the flap of the envelope positioned by said flap positioning unit and transporting the envelope by the flap to a position in the product conveying path of its respective sequentially delivered product, wherein said shuttle unit has a shuttle which rotates for transporting each envelope by its flap to a position in the product conveying path, and whereby its respective sequentially delivered product is inserted within the envelope to create a package.

2. The apparatus for inserting a product in an envelope in accordance with claim 1, wherein said shuttle includes a holding device to hold the flap of the envelope positioned on said shuttle unit by said flap positioning unit, said shuttle is operationally connected to means to rotate said shuttle so as to move said holding device from a position adjacent said flap positioning unit to the position adjacent said conveying device.

3. The apparatus for inserting a product in an envelope in accordance with claim 2, wherein said holding device includes means providing a vacuum for holding the flap of the envelope positioned by said flap positioning unit and transporting the envelope by the flap to the position in the product conveying path of its respective sequentially delivered product.

4. The apparatus for inserting a product in an envelope in accordance with claim 1, wherein said shuttle has first and second holding devices to hold the flap of the envelope positioned on said shuttle unit by said flap positioning unit, whereby the flap of another envelope can be positioned by said flap positioning unit on one of said first and second holding devices of said shuttle unit as a sequentially delivered product is inserted within an envelope held by its flap by the other of said first and second holding devices in the product conveying path.

5. The apparatus for inserting a product in an envelope in accordance with claim 3, wherein said first and second holding devices have means providing a vacuum for holding the flap of the envelope positioned by said flap positioning unit and transporting the envelope by the flap to the position in the product conveying path of its respective sequentially delivered product.

6. The apparatus for inserting a product in an envelope in accordance with claim 3, wherein said first and second holding devices are spaced on opposite sides of said shuttle unit.

7. The apparatus for inserting a product in an envelope in accordance with claim 1, further comprising an air blast device located adjacent the position in the product conveying path and positioned to prepare the envelope to receive its respective sequentially delivered product.

8. The apparatus for inserting a product in an envelope in accordance with claim 7, further comprising means for holding the envelope open to receive its respective sequentially delivered product, said holding means located adjacent the position in the product conveying path.

9. The apparatus for inserting a product in an envelope in accordance with claim 8, wherein said holding means includes a plurality of fingers movable into the envelope to hold the envelope open to receive its respective sequentially delivered product.

10. The apparatus for inserting a product in an envelope in accordance with claim 1, further comprising means for holding the envelope open to receive its respective sequentially delivered product, said holding means located adjacent the position in the product conveying path.

11. The apparatus for inserting a product in an envelope in accordance with claim 10, wherein said holding means includes a plurality of fingers movable into the envelope to hold the envelope open to receive its respective sequentially delivered product.

12. The apparatus for inserting a product in an envelope in accordance with claim 1, wherein said flap positioning unit includes means for engage the flap of the envelope for positioning the flap of the envelope on said shuttle unit.

13. The apparatus for inserting a product in an envelope in accordance with claim 12, wherein said means for engaging the flap of the envelope for positioning the flap of the envelope on said shuttle unit includes a tamper device cooperating with said shuttle unit for relatively moving the flap of the envelope to position the flap on said shuttle unit.

14. The apparatus for inserting a product in an envelope in accordance with claim 13, wherein said tamper device and said shuttle unit are relatively moveable toward each other to position the flap on said shuttle unit.

15. The apparatus for inserting a product in an envelope in accordance with claim 14, wherein said tamper device includes means for rotating said tamper device to position the flap on said shuttle unit.

16. The apparatus for inserting a product in an envelope in accordance with claim 15, wherein said tamper device includes rotatable crank arms having a tamper pivotably mounted thereon.

17. The apparatus for inserting a product in an envelope in accordance with claim 16, wherein said means for rotating said tamper device rotates said crank arms.

18. The apparatus for inserting a product in an envelope in accordance with claim 17, wherein said tamper device has abutment means for pivoting said tamper in said crank arms as said crank arms are rotated by said means for rotating said tamper device.

19. The apparatus for inserting a product in an envelope in accordance with claim 12, wherein said means for engaging the flap of the envelope for positioning the flap of the envelope on said shuttle unit includes an air blast device to initiate movement of the flap of the envelope toward said shuttle unit.

20. The apparatus for inserting a product in an envelope in accordance with claim 1, further including a envelope hopper providing a reservoir of envelopes for said flap position unit.

21. The apparatus for inserting a product in an envelope in accordance with claim 1, wherein the sequentially delivered product is a folded document.

22. An apparatus for closing a sealable flap on a package formed of an envelope containing a product, which comprises:

(a) a package conveying device for delivering one sequentially delivered package at a time along a package conveying path;

(b) first and second rollers forming a first pair of rollers in the package conveying path for receiving each sequentially delivered package from said package conveying device, said first roller having an enlarged diameter at its midsection for at least partially sealing the flap of each sequentially delivered package and forcing trapped air from each sequentially delivered package; and (d) third and fourth rollers forming a second pair of rollers adjacent said first pair of rollers for receiving each sequentially delivered package from said first pair of rollers, said third and fourth rollers are matched so as to provide substantially even pressure across the flap of each sequentially delivered package to fully seal the flap of each sequentially delivered package.

23. The apparatus for closing a sealable flap on a package formed of an envelope containing a product in accordance with claim 22, further comprising a water blast device located adjacent the package conveying path to moisten adhesive on the sealable flap.

24. The apparatus for closing a sealable flap on a package formed of an envelope containing a product in accordance with claim 22, further comprising means for engaging the sealable flap located adjacent the package conveying path to initiate movement of the sealable flap prior to said first pair of rollers.

25. An apparatus for inserting a product in an envelope to form a package and for closing a sealable flap on the envelope, which comprises:

(a) an inserting device comprising:

(i) a product conveying device for delivering one sequentially delivered product at a time along a product conveying path, (ii) a flap positioning unit for positioning a flap of an envelope on a shuttle unit adjacent said product conveying device for each sequentially delivered product, and (iii) a shuttle unit for holding the flap of the envelope positioned by said flap positioning unit and transporting the envelope by the flap to a position in the product conveying path of its respective sequentially delivered product, whereby its respective sequentially delivered product is inserted within the envelope to create a package; and (b) a package closing device comprising:

(i) a package conveying device for delivering one sequentially delivered package at a time along a package conveying path from said inserting device, (ii) first and second rollers forming a first pair of rollers in the package conveying path for receiving each sequentially delivered package from said package conveying device, said first roller having an enlarged diameter at its midsection for at least partially sealing the flap of each sequentially delivered package and forcing trapped air from each sequentially delivered package, and (iii) third and fourth rollers forming a second pair of rollers adjacent said first pair of rollers for receiving each sequentially delivered package from said first pair of rollers, said third and fourth rollers are matched so as to provide substantially even pressure across the flap of each sequentially delivered package to fully seal the flap of each sequentially delivered package.

26. A method for inserting a product in an envelope thereby forming a package, which comprises the steps of:

(a) providing an inserting device comprising:

(i) a product conveying device for delivering one sequentially delivered product at a time along a product conveying path, (ii) a flap position unit for positioning a flap of an envelope on a shuttle unit adjacent said product conveying device for each sequentially delivered product, and (iii) a shuttle unit for holding the flap of the envelope positioned by said flap positioning unit and transporting the envelope by the flap to a position in the product conveying path of its respective sequentially delivered product, wherein said shuttle unit has a shuttle which rotates for transporting each envelope by its flap to a position in the product conveying path, and whereby its respective sequentially delivered product is inserted within the envelope to create a package;

(b) providing a sequentially delivered product on said product conveying device;

(c) providing an envelope with a flap to said flap positioning unit for each sequentially delivered product;

(d) positioning the flap of the envelope on the shuttle unit adjacent said product conveying device for each sequentially delivered product;

(e) holding the flap of the envelope positioned by said flap positioning unit on said shuttle unit;

(f) having the shuttle unit transport the envelope by the flap to a position in the product conveying path of its sequentially delivered product; and (g) inserting the sequentially delivered product within the envelope to create a package.

27. The method for inserting a product in an envelope in accordance with claim 26, wherein said holding step includes providing a vacuum for holding the flap of the envelope positioned by said flap positioning unit.

28. The method for inserting a product in an envelope in accordance with claim 26, further including the step of positioning the flap of another envelope by said flap positioning unit on said shuttle unit as a sequentially delivered product is inserted within an envelope held by its flap by said shuttle unit in the product conveying path.

29. The method for inserting a product in an envelope in accordance with claim 26, further including the step of providing an air blast into the envelope located in the position in the product conveying path to prepare the envelope to receive its respective sequentially delivered product.

30. The method for inserting a product in an envelope in accordance with claim 29, further comprising the step of holding the envelope in the position in the product conveying path open to receive its respective sequentially delivered product.

31. The method for inserting a product in an envelope in accordance with claim 30, wherein said holding open step includes providing a plurality of fingers movable into the envelope to hold the envelope open to receive its respective sequentially delivered product.

32. The method for inserting a product in an envelope in accordance with claim 26, further comprising the step of holding the envelope in the position in the product conveying path open to receive its respective sequentially delivered product.

33. The method for inserting a product in an envelope in accordance with claim 32, wherein said holding open step includes providing a plurality of fingers movable into the envelope to hold the envelope open to receive its respective sequentially delivered product.

34. The method for inserting a product in an envelope in accordance with claim 26, wherein said flap positioning step includes engaging the flap of the envelope for positioning the flap of the envelope on the shuttle unit.

35. The method for inserting a product in an envelope in accordance with claim 34, wherein said flap engaging step includes using a tamper device cooperating with said shuttle unit for relatively moving the flap of the envelope to position the flap on said shuttle unit.

36. The method for inserting a product in an envelope in accordance with claim 35, wherein said tamper device and said shuttle unit are relatively moveable toward each other to position the flap on said shuttle unit.

37. The method for inserting a product in an envelope in accordance with claim 36, wherein said tamper device rotates to position the flap on said shuttle unit.

38. The method for inserting a product in an envelope in accordance with claim 37, wherein said tamper device includes rotatable crank arms having a tamper pivotably mounted thereon.

39. The method for inserting a product in an envelope in accordance with claim 38, wherein said step of rotating said tamper device rotates said crank arms.

40. The method for inserting a product in an envelope in accordance with claim 39, wherein said tamper device has abutment means which pivots said tamper in said crank arms as said crank arms are rotated by during said step of rotating said tamper device.

41. The method for inserting a product in an envelope in accordance with claim 26, wherein said step of positioning the flap of the envelope on said shuttle unit includes providing an air blast to initiate movement of the flap of the envelope toward said shuttle unit.

42. The method for inserting a product in an envelope in accordance with claim 26, further including the step of providing a reservoir of envelopes for said flap position unit.

43. The method for inserting a product in an envelope in accordance with claim 26, wherein the sequentially delivered product is a folded document.

44. A method for closing a sealable flap on a package formed of an envelope containing a product, which comprises the steps of:

(a) providing a package closing device comprising:

(i) a package conveying device for delivering one sequentially delivered package at a time along a package conveying path, (ii) first and second rollers forming a first pair of rollers in the package conveying path for receiving each sequentially delivered package from said package conveying device, said first roller having an enlarged diameter at its midsection for at least partially sealing the flap of each sequentially delivered package and forcing trapped air from each sequentially delivered package, and (iii) third and fourth rollers forming a second pair of rollers adjacent said first pair of rollers for receiving each sequentially delivered package from said first pair of rollers, said third and fourth rollers are matched so as to provide substantially even pressure across the flap of each sequentially delivered package to fully seal the flap of each sequentially delivered package;

(b) providing a sequentially delivered package on said package conveying device;

(c) conveying the sequentially delivered package to said first pair of rollers in the package conveying path to at least partially seal the flap of the sequentially delivered package and force trapped air from the sequentially delivered package; and (d) conveying the sequentially delivered package from said first pair of rollers to said second pair of rollers to fully seal the flap of the sequentially delivered package.

45. The method for closing a sealable flap on a package formed of an envelope containing a product in accordance with claim 44, further comprising the step of providing a water blast located adjacent the package conveying path to moisten adhesive on the sealable flap.

46. The apparatus for closing a sealable flap on a package formed of an envelope containing a product in accordance with claim 44, further comprising the step of engaging the sealable flap to initiate movement of the sealable flap prior to said first pair of rollers.

47. A method for inserting a product in an envelope to form a package and for closing a sealable flap on the package, which comprises the steps of:

(a) providing an inserting device comprising:

(i) a product conveying device for delivering one sequentially delivered product at a time along a product conveying path, (ii) a flap positioning unit for positioning a flap of an envelope on a shuttle unit adjacent said product conveying device for each sequentially delivered product, and (iii) a shuttle unit for holding the flap of the envelope positioned by said flap positioning unit and transporting the envelope by the flap to a position in the product conveying path of its respective sequentially delivered product, whereby its respective sequentially delivered product is inserted within the envelope to create a package;

(b) providing a sequentially delivered product on said product conveying device;

(c) providing an envelope with a flap to said flap positioning unit for each sequentially delivered product;

(d) positioning the flap of the envelope on the shuttle unit adjacent said product conveying device for each sequentially delivered product;

(e) holding the flap of the envelope positioned by said flap positioning unit on said shuttle unit;

(f) having the shuttle unit transport the envelope by the flap to a position in the product conveying path of its sequentially delivered product;

(g) inserting the sequentially delivered product within the envelope to create a sequentially delivered package;

(h) providing a package closing device comprising:

(i) a package conveying device for delivering one sequentially delivered package at a time along a package conveying path, (ii) first and second rollers forming a first pair of rollers in the package conveying path for receiving each sequentially delivered package from said package conveying device, said first roller having an enlarged diameter at its midsection for at least partially sealing the flap of each sequentially delivered package and forcing trapped air from each sequentially delivered package, and (iii) third and fourth rollers forming a second pair of rollers adjacent said first pair of rollers for receiving each sequentially delivered package from said first pair of rollers, said third and fourth rollers are matched so as to provide substantially even pressure across the flap of each sequentially delivered package to fully seal the flap of each sequentially delivered package;

(i) providing the sequentially delivered package on said package conveying device;

(j) conveying the sequentially delivered package to said first pair of rollers in the package conveying path to at least partially seal the flap of the sequentially delivered package and force trapped air from the sequentially delivered package; and (k) conveying the sequentially delivered package from said first pair of rollers to said second pair of rollers to fully seal the flap of the sequentially delivered package.

* * * * *